United States Patent [19]

Spodig

[11] 3,948,766

[45] Apr. 6, 1976

[54] MAGNETIC SEPARATOR

[76] Inventor: Heinrich Spodig, Netteberge 84, 4711 Bork, Westfalen, Germany

[22] Filed: June 25, 1973

[21] Appl. No.: 372,706

[30] Foreign Application Priority Data

June 27, 1972 Germany ..... 2231380

[52] U.S. Cl. ..... 209/219; 209/216

[51] Int. Cl.[2] ..... B03C 1/10

[58] Field of Search ..... 209/219, 218, 223, 232, 209/214, 216, 222; 210/222, 223

[56] References Cited

UNITED STATES PATENTS

| | | | |
|---|---|---|---|
| 281,782 | 7/1883 | Moore | 209/219 |
| 833,169 | 10/1906 | Knowles | 209/218 |
| 1,068,453 | 7/1913 | Rowand | 209/219 |
| 2,177,809 | 10/1939 | Queneau | 209/219 |
| 2,188,517 | 1/1940 | Payne | 209/219 |
| 3,246,753 | 4/1966 | Laurila | 209/223 X |
| 3,326,374 | 6/1907 | Jones | 209/232 X |
| 3,627,678 | 12/1971 | Marston | 210/222 X |

FOREIGN PATENTS OR APPLICATIONS

| | | | |
|---|---|---|---|
| 183,325 | 8/1907 | Germany | 209/218 |
| 213,696 | 10/1956 | Australia | 209/219 |
| 666,907 | 5/1929 | France | 209/219 |
| 724,621 | 2/1955 | United Kingdom | 209/222 |
| 704,597 | 2/1954 | United Kingdom | 209/223 |

*Primary Examiner*—Robert Halper
*Attorney, Agent, or Firm*—Michael J. Striker

[57] ABSTRACT

The device comprises a magnetic circuit having an air gap into which a mixture of magnetically attractable and magnetically non-attractable materials can be passed. The magnetic circuit includes a rotatably mounted separator roller comprised of magnetizable material, with the periphery of the roller being located adjacent to the air gap. The magnetic circuit further includes a permanent magnet arrangement located exteriorly of the separator roller and operative for establishing a flow of flux through the magnetic circuit and across the air gap and operates for magnetizing the separator roller by induction so that magnetically attractable material in a mixture entering the air gap will be segregated by the separator roller.

17 Claims, 9 Drawing Figures

MAGNETIC SEPARATOR

BACKGROUND OF THE INVENTION

The invention relates to a permanent magnet separating device. Problems still exist with the prior-art techniques of sorting and separating fine and very fine, magnetizable and slightly magnetizable granular material from finely ground particulate material (particle size 5 to 10 microns) having a dry, pasty or more or less fluid consistency, as well as with the prior-art techniques of sorting and separating magnetizable particles when the magnetizable particles are mixed with larger unmagnetic particles of a mixture, with the particles of such mixture being to some extent sintered or baked on to each other.

Prior-art magnetic separators, both automatic and non-automatic in the form of vertical filters, gratings, plates, rotating cylinders, etc., are provided with magnet arrangements so constructed that only the inhomogeneous magnetic stray or leakage flux is actually exploited to effect the separation of the magnetizable particles, with the major part of the magnetic force field passing through the interior of the system itself and not being made full use of. The leakage flux passing exteriorly of the magnetic circuitry in the prior-art arrangements and serving to effect the actual separation of magnetic particles from a mixture of magnetic and non-magnetic particles, will have a flux density of between about 300 and 1000 gausses, depending upon the particular construction. With some constructions it is even possible to achieve a flux density as high as 2000 gausses. When mainly the inhomogeneous leakage and stray flux of a magnetic circuit is employed to separate magnetic particles out of a mixture, it is not possible to separate out particles having particle sizes as small as mentioned above. Extensive laboratory testing has indicated that for the magnetic separation of such small magnetically attractable particles from the non-magnetic remainder of a mixture of fine particles, a flux density more on the order of 10,000 gausses is required, and in very difficult cases the necessary flux density to produce a satisfactory separation may even be as high as 30,000 gausses.

Attempts have already been made to improve the technique of magnetic sorting by building magnetic circuits which develop a highly directed, highly homogeneous magnetic field. One such construction makes use of two parallel magnetic cylindrical separator drums spaced apart from each other to form an adjustable separating zone or gap. In the interior of each of the two separator drums is located a stationary magnet oriented in direction towards the gap between the parallel drums so that magnetic flux will cross the gap in passing from one internal magnet to the other internal magnet. A return-flow path for magnetic flux is provided externally of the drums to form a magnetic circuit including the air gap between the drums, with the magnetic flux passing through the circuit thereupon passing through the air gap between the separator drums.

Another prior-art separator, in contrast to the one just described, comprised a single rotatably mounted cylindrical magnet drum provided at its circumferential periphery with axially extending bars of ferromagnetic material alternating with axially extending bars of non-magnetic material. The construction is in other respects the same as the one just described. One pole of a magnet located inside the drum is positioned in proximity to the inner periphery of the separator drum, while the opposite pole of the magnet is connected to a magnetic circuit branch extending from such opposite pole and ending at a distance from the separator drum with such an orientation as to form a radial air gap with the periphery of the drum. In order to increase the force of magnetic attraction, additional magnets can be connected in the magnetic circuit with their poles so oriented as to increase the flow of magnetic flux through the circuit, and advantageously being positioned at the portion of the magnetic circuit near the aforementioned gap formed with the separator drum. Between the magnet drum and the auxiliary pole just referred to, one prior-art construction has further included a solid cylindrical roller made from iron and magnetized by a further auxiliary pole extending from the basic magnetic circuit and partially including and magnetizing the solid cylindrical roller. With such a construction, the solid roller of iron contributed to the separation of the magnetic components by the magnet drum.

Using such improved constructions higher magnetic flux densities have been achieved, about 7,000 gauss. Stronger fields cannot be established because, on the one hand, the positioning of the magnetizing magnets within the interior of the hollow separator drum is limited both with respect to size and orientation by the limitation of space in the drum interior. Furthermore, the magnetizing magnet arrangements located inside the hollow separator drum are of course positioned with some clearance from the rotating inner periphery of the drum. The flux passing through the magnetic circuit must cross not only the work gap adjacent to the exterior drum periphery, but must also pass across this interiorly located gap. This results in the development of a significant stray flux which does not contribute to the effectiveness of the separating operation.

SUMMARY OF THE INVENTION

It is the general object of the invention to provide a magnetic separator device which overcomes the limitations of the prior-art constructions.

It is a more particular object of the invention to provide a magnetic separator device which is more effective, particularly when mixtures of very small particles are involved, than were the constructions of the prior art.

It is a further object of the invention to provide a magnetic separator device which operates with magnetic fields of markedly higher strength.

These objects, and others which will become more understandable from the following description can be met according to the invention by providing a permanent-magnet magnetic separator device, comprising a magnetic circuit having an air gap into which a mixture of attractable and non-attractable materials can be passed, the magnetic circuit including a rotatably mounted separator roller comprised of magnetizable material, with the periphery of the roller being located adjacent to the air gap, and the magnetic circuit further including permanent magnet means located exteriorly of the separator roller and operative for establishing a flow of flux through the magnetic circuit and across the air gap and being operative for magnetizing the separator roller by induction so that magnetically attractable material in a mixture entering the air gap will be segregated by the separator roller.

By providing the magnetized permanent magnet structure of the magnetic circuit exteriorly of the rotating separator roller, instead of interiorly thereof as in the prior art, a great increase in separating effectiveness can be achieved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
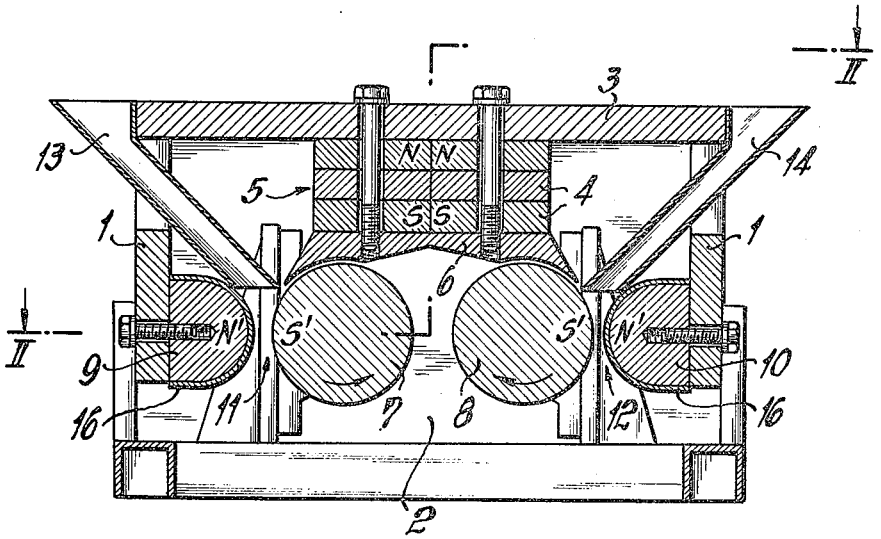
FIG. 1 is a cross-sectional view, taken along plane I—I of FIG. 2, of a first magnetic separator according to the invention.
Figure 2:
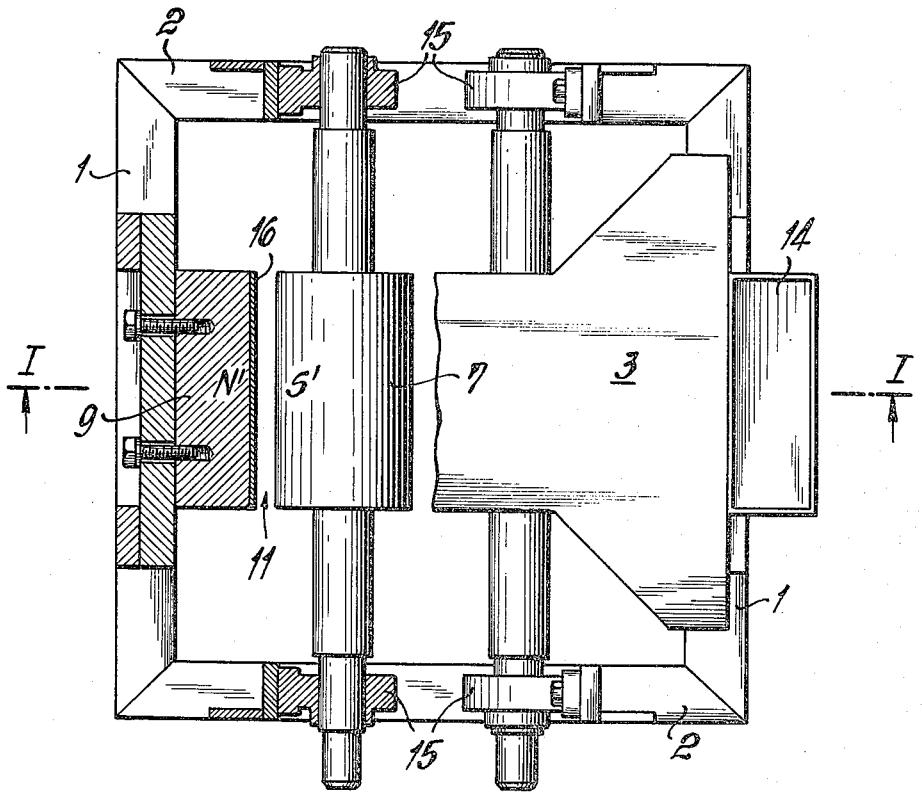
FIG. 2 is a cross-sectional view of the separator shown in FIG. 1, taken along the plane II—II of FIG. 1.

FIGS. 1 and 2 illustrate a first permanent-magnet magnetic separator according to the invention. The structure there illustrated includes two parallel magnetic circuit flux-path members 1, and two further parallel support members 2. The members 1 and 2 together form a structure of generally quadratic configuration. The illustrated magnetic circuitry further includes an upper horizontal yoke plate 3 of magnetically conductive material, serving simultaneously to support from above a downwardly hanging magnet arrangement 5 comprised of individual permanent magnet members 4 and a pole shoe portion 6 for the magnet members 4. The magnet circuitry further includes two magnetic separator rollers 7, 8 of magnetizable material. Finally, the magnetic circuitry includes two half-round members 9, 10 of magnetizable material connected to the magnetic circuit flux-path members 1 by means of threaded bolts. The half-round members 9 and 10 are each spaced from a respective one of the two separator rollers 7, 8 to form two radial air gaps 11 and 12 extending along the length of the respective separator roller.

The pole shoe 6 of the permanent magnet arrangement 5 is so shaped as to include two cylindrical portions each concentric with a respective one of the two separator rollers 7, 8 and forming with a portion of the circumferential periphery of the two rollers 7, 8 two very short uniform radial clearances. The extremely close proximity of the rollers 7 and 8 to the magnet arrangement 5 causes the magnet arrangement 5 to magnetize both rollers by induction. Inasmuch as both rollers 7, 8 are positioned in proximity to the south-pole end of the magnet arrangement 5, the two separator rollers 7, 8 act as extensions of the south-pole end of the magnet arrangement 5; this is represented symbolically by the letter S′ appearing at each of the two rollers 7, 8.

The half-round members 9, 10 of magnetizable material, on the other hand, are in direct contact with magnetic circuit flux-path members 1, which in turn are in direct contact with magnetic circuit member 3, which in turn is directly connected to and supports from above the magnet arrangement 5 at the north-pole end of the latter. The north-pole end of the magnet arrangement 5 accordingly magnetizes the half-round members 9, 10, by induction, via the intermediate magnetic circuit members 3 and 1. As a result of such magnetization by induction, the half-round members 9, 10 both become magnetic extensions of the north-pole end of the permanent magnet arrangement 5; this is represented symbolically in FIGS. 1 and 2 by the designation N′.

It will be clear that the above-described magnetic circuitry comprises two separate loops for the travel of magnetic flux. As viewed in FIG. 1, one such circuit loop proceeds from the right-hand north-pole end of the magnet arrangement 5 clockwise through the right-hand half of member 3, downwards through the right-hand member 1, leftwards through the half-round member 10, across the air gap 12, through the roller 8, and back to the south-pole end of the right-hand half of the magnet arrangement 5. The other circuit loop is the mirror reflection of the one just described, is comprised of the structure to the left of the symmetry line of the arrangement, and provides a path for the travel of flux in counterclockwise direction from the north-pole end to the south-pole end of the left-hand portion of the magnet arrangement 5.

It will be understood by persons skilled in the art that the flux established in the two magnetic circuit loops just described crosses the air gaps 11, 12 at the shortest portion of the radial air gaps. Accordingly, there is a very high concentration of flux within the shortest portion of the air gaps 11, 12. Mixtures of magnetically attractable and magnetically non-attractable material are passed into the air gaps 11 and 12 by means of chutes 13 and 14. When such a mixture enters one of the air gaps 11, 12, its magnetic fraction is attracted to the respective separator roller 7 or 8. The rollers 7, 8 are journalled for rotation on journals 15, and are turned in the direction of the arrows by non-illustrated drive means, such as a conventional electric motor. Although both the rollers 7, 8 and also the half-round members 9, 10 are temporarily magnetized by induction and therefore exert an attractive force on the magnetically attractable material in the mixture to be separated, the magnetically attractable material will for the most part be pulled only to the rollers 7, 8, and not to the half-round members 9, 10. This is because the separator rollers 7, 8 are located immediately proximate to the magnet arrangement 5, separated therefrom only by a negligible air gap, whereas the half-round members 9, 10 are connected to the north-pole end of the magnet arrangement through the intermediary of the relatively long magnetic circuit flux-path members 1 and 3. Moreover, the half-round exposed surfaces of the half-round members 9, 10 are covered by respective layers 16 of non-magnetic material, to reduce the surface magnetic attraction force component of the half-round members 9, 10 acting on the magnetically attractable material. Accordingly, magnetically attractable material in a mixture entering one of the air gaps 11, 12 will be attracted almost exclusively to the respective separator roller. A small portion of the magnetically attractable material may be initially attracted to the half-round members 9 and 10 and be held for a while against the non-magnetic covering layers 16 thereof; however, within a short time such material will be attracted to the respective separator roller 7 or 8, and accordingly no continuing accumulation of magnetic material on the half-round bodies 9 and 10 will occur.

As will be evident from the drawing, the magnetically non-attractable material in the mixture entering one of the gaps 11, 12 will simply fall vertically downwards through the gap, where it may be permitted to accumulate or else be carried away in a continuous manner by a conveyor belt or the like. The magnetically attracted material, on the other hand, will remain on the surface of the respective separating roller, during rotation thereof in the indicated direction, for approximately 90° or so of roller rotation. Persons skilled in the art will understand that although the entire main body of the roller 7 may be formed of the same magnetizable material, the path of magnetic flux in the respective magnetic circuit loop will for the most part pass to the pole shoe 6 along the shortest possible route through the material of the separator roller. Accordingly, material attracted to the roller 7, for example, at the 9 o'clock portion thereof will fall off the roller, due to insufficient attractive force, by the time such material reaches the 7 o'clock or 6 o'clock position. The magnetically attractable and non-attractable components of the mixture, thus fall into adjacent but spaced piles. If desired, a vertical separating wall can be provided intermediate these two dumping locations, to prevent remixture of the materials if the dumped piles are to be permitted to grow in size.

In the embodiment of FIGS. 1 and 2 the upright journal members 15 are shiftable by means of non-illustrated adjusting screws to permit adjustment of the width of each of the two air gaps 11 and 12.

Figure 3:
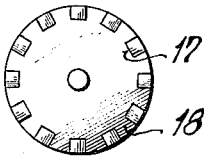
FIG. 3 is a cross-sectional view of a separator roller according to the invention.

FIG. 3 shows, in cross-section, a magnetic separator roller which can be used in place of the homogeneous magnetic separator rollers employed in FIGS. 1 and 2. The roller of FIG. 3 is provided at its peripheral portions with circumferentially spaced axially extending elongated portions 17 of non-magnetic material. Persons skilled in the art will understand that when such a roller is used, the magnetic flux passing across the roller periphery will be constrained to pass through the magnetic peripheral portions 18, resulting in an increase in the density of flux at such portions.

Figure 4:
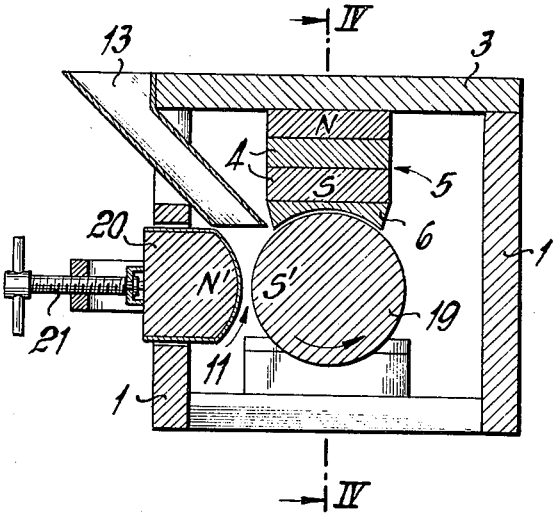
FIG. 4 is a cross-sectional view taken through a second magnetic separator according to the invention.
Figure 5:
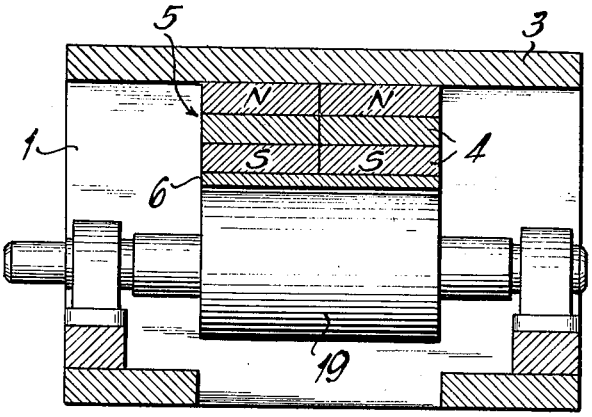
FIG. 5 is a cross-sectional view of the separator shown in FIG. 4, the section being taken along the plane IV—IV indicated in FIG. 4.

FIGS. 4 and 5 illustrate a second permanent-magnet magnetic separator device. In so far as this second device is similar to the first device already described, the similar features will not be referred to.

It is noted that the device in FIGS. 4 and 5 employs only a single magnetic separator roller, designated 19, cooperating with a single half-round body 20 of magnetizable material, to form a single air gap 11 into which a mixture to be separated can be passed. In this embodiment, the air gap 11 is adjustable by means of a hand screw 21. The operation of the device is basically the same as that of the device shown in FIGS. 1 and 2.

Figure 6:
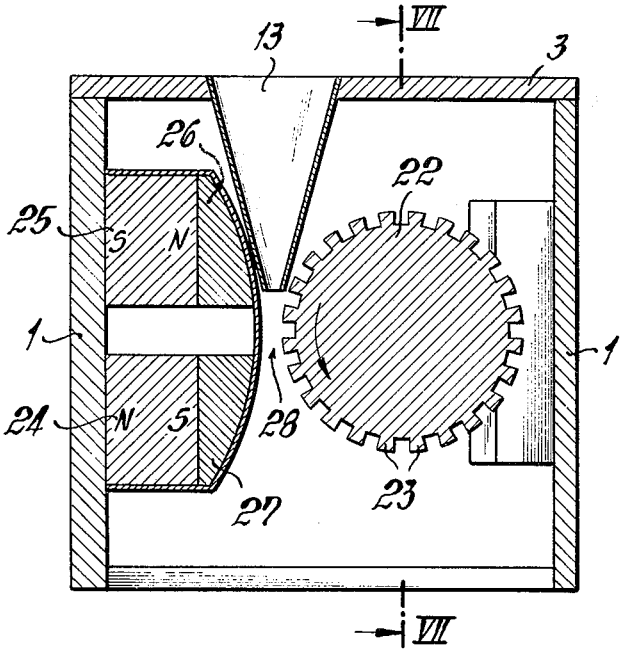
FIG. 6 depicts in cross-section a third magnetic separator.
Figure 7:
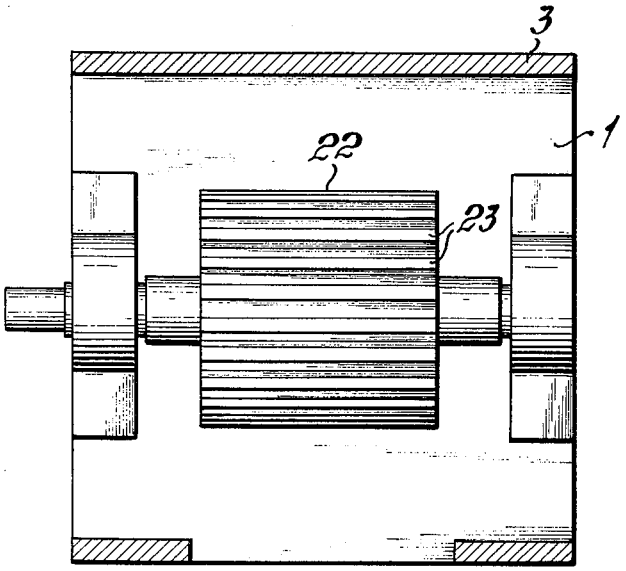
FIG. 7 is a section through FIG. 6 along the plane VII—VII.

FIGS. 6 and 7 illustrate a third permanent-magnet magnetic separator device. In this embodiment, a toothed separator roller 22, having teeth 23, is used in place of a roller having an unbroken cylindrical surface. The purpose of providing the axially extending teeth 23 is to create the intermediate axially extending slots which perform a function analogous to that of the non-magnetic portions 17 in FIG. 3. As with the roller of FIG. 3, the magnetic flux is constrained to pass predominantly through the low-reluctance portions of the cylinder periphery, thereby increasing the density of flux passing through such portions. In this embodiment, two permanent magnet members 24 and 25, provided with respective pole shoes 26 and 27, are positioned in proximity to the peripheral surface of the roller 22. However, the orientations of the two magnets with respect to the adjoining cylinder portion are opposite to each other. The path for magnetic flux is accordingly from the north-pole end of the magnet 25 through the lower right-hand corner of pole shoe 26, across the air gap 28, through the nearest tooth of the toothed roller 22, thence back out of the roller through the next lower tooth, and then again across the air gap 28 in opposite direction, to the upper right-hand corner of pole shoe 27, and then to the south-pole end of magnet 24. Flux will also flow from the north-pole end of magnet 24 through the permeable material of member 1 to the south-pole end of magnet 25.

The operation of the embodiment of FIGS. 6 and 7 is similar to that of those previously described. A mixture of magnetically attractable and non-attractable material is passed into the air gap 28 by means of a chute 13. A non-illustrated drive motor turns the separator roller 22 in the indicated direction. The magnetically attractable material is attracted to the teeth of the roller 22 at the narrowest portion of air gap 28, and remains attracted to the roller until the respective roller portion reaches the 7 o'clock or 6 o'clock position, whereupon the magnetically attracted material falls off the roller. The magnetically non-attracted material falls vertically downwards through the gap 28.

Figure 8:
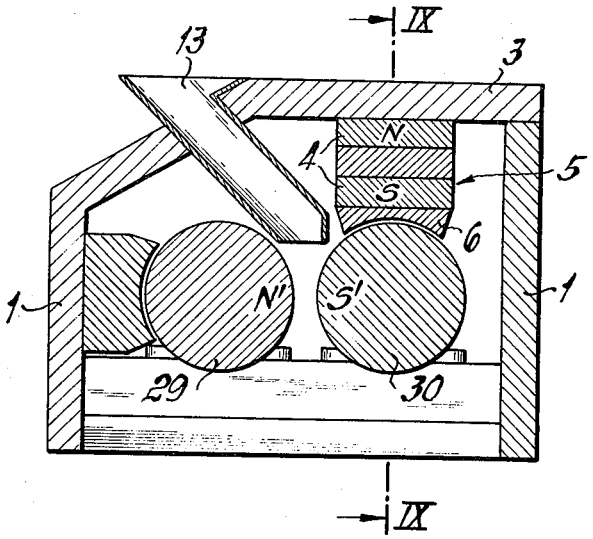
FIG. 8 depicts in cross-section a fourth magnetic separator.
Figure 9:
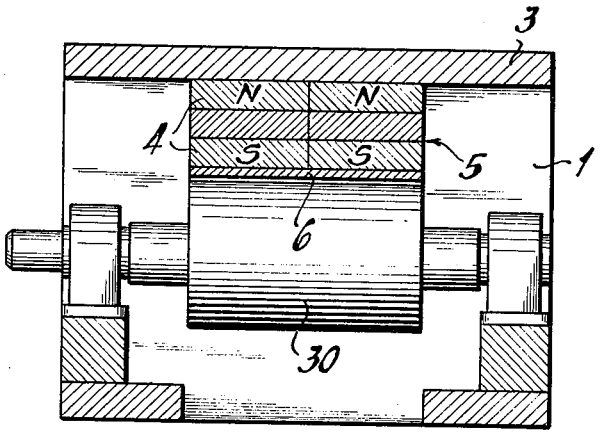
FIG. 9 is a section through FIG. 8 taken along the plane IX—IX.

The embodiment shown in FIGS. 8 and 9 is similar in principle to that shown in FIGS. 4 and 5. In FIGS. 8 and 9, however, a stationary half-round pole shoe member is not used; instead a rotatable cylindrical pole shoe member 29 cooperates with separator roller 30 to form the magnetic circuit air gap into which a mixture to be separated is passed. Both the roller 29 and the roller 30 are magnetized by induction and therefore exert an attractive force on magnetically attractable material entering the air gap. However, the attractive force of roller 30 is considerably greater because of its immediate proximity to the magnetizing permanent magnet arrangement 5, and the magnetically attractable material will be attracted almost exclusively to the separator roller 30. A non-illustrated drive motor drives the roller 30 in counterclockwise direction, and the roller 29 in clockwise direction. Material attracted to a surface portion of the roller 30 at the 9 o'clock position will remain held against the roller until the surface portion reaches the 7 o'clock or 6 o'clock position, whereupon the magnetic material will fall off. Accordingly, two separate piles of material will be formed. If desired, a vertical separating wall can be positioned intermediate the two dumping locations, to prevent re-mixing of the separated materials.

It will be understood that each of the elements described above, or two or more together, may also find a useful application in other types of constructions differing from the types described above.

While the invention has been illustrated and described as embodied in a permanent-magnet magnetic separator device, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore such adaptations should and are intended to be comprehended within the meaning and range of equivalence of the following claims.

What is claimed as new and desired to be protected by Letters Patent is set forth in the appended claims:

1. A permanent-magnet magnetic separator device, comprising a magnetic circuit having an air gap into which a mixture of magnetically attractable and magnetically non-attractable materials is to be passed, said magnetic circuit including a separator member comprised of magnetizable material, said separator member being located adjacent to said air gap, and said magnetic circuit further including permanent magnet means operative for establishing a flow of flux through said magnetic circuit and across said air gap and operative for magnetizing said separator member by induction so that magnetically attractable material in a mixture entering said air gap will be segregated by said separator member, wherein said device comprises a quadratic support structure comprised of two spaced and parallel magnetically conductive portions and two further portions perpendicular to said two spaced magnetically conductive portions, and wherein said device includes two elongated parallel spaced separator members, and wherein said magnetic circuit includes two air gaps, with one separator member being located adjacent to one air gap and the other separator member being located adjacent to the other air gap, with said separator members being oriented parallel to said two parallel magnetically conductive portions, and wherein said magnetic circuit further includes a connecting member of magnetically permeable material connecting together said two portions of magnetically conductive material and extending in direction transverse to the elongation of said separator members, and wherein said permanent magnet means comprises a permanent magnet arrangement comprised of a plurality of permanent magnet members supported from above by said connecting member and having a pole shoe portion proximate to and partially surrounding said separator members, to magnetize said separator members by induction, and elongated half-round members of magnetically conductive material each extending parallel to but spaced from a respective one of said separator members to define with the latter a respective one of said air gaps, and wherein said half-round members are connected in magnetic circuit with said parallel magnetically conductive portions and with said connecting member so that said half-round members are magnetized by said permanent magnet arrangement by induction with a polarity opposite to the induced polarity of said separator members.

2. A device as defined in claim 1, wherein said permanent magnet arrangement is located outside said separator member.

3. A device as defined in claim 1, wherein said half-round members are mounted on the facing sides of said parallel magnetically conductive portions.

4. A device as defined in claim 1, wherein said half-round members are covered with respective layers of magnetically non-conductive material.

5. A device as defined in claim 1, wherein each of said air gaps is adjustable to effect variations of the magnetic field strength.

6. A device as defined in claim 1, wherein at least one of said separator members is a rotatably mounted separator roller comprised of magnetizable material having a circumferential periphery located adjacent to the respective air gap.

7. A device as defined in claim 1, wherein at least one of said separator members is a rotatably mounted separator roller comprised of magnetizable material having a circumferential periphery located adjacent to said air gap, and wherein said permanent magnet arrangement is located exteriorly of said separator roller.

8. A device as defined in claim 7, wherein said separator roller is a solid roller.

9. A device as defined in claim 7, wherein said separator roller is a hollow roller.

10. A device as defined in claim 7 wherein the flux established in said magnetic circuit is produced only by said permanent magnet arrangement located exteriorly of said separator roller.

11. A device as defined in claim 7, wherein said permanent magnet arrangement comprises a volume of permanently magnetized material larger than the volume of said separator roller.

12. A device as defined in claim 7, wherein said separator roller is hollow, and wherein said permanent magnet arrangement comprises a volume of permanently magnetized material larger than the volume of the interior of said hollow separator roller.

13. A device as defined in claim 7, wherein said separator roller comprises at the region of its circumferential periphery a plurality of circumferentially successive portions of nonmagnetic material, whereby to increase the density of flux passing through the magnetic portions of the periphery of said roller.

14. A device as defined in claim 7, wherein said separator roller is cylindrical and comprises at the region of its circumferential periphery circumferentially spaced axially extending portions of non-magnetic material, whereby to increase the density of flux passing through the magnetic portions of the circumferential periphery of said roller.

15. A device as defined in claim 7, wherein said separator roller is cylindrical and is provided at the region of its circumferential periphery with circumferentially spaced axially extending channels, whereby to increase the density of flux passing through the magnetic portions adjoining said channels.

16. A device as defined in claim 7, wherein said permanent magnet arrangement is located in said magnetic circuit adjacent to but spaced from the periphery of said separator roller.

17. A device as defined in claim 16, wherein said permanent magnet arrangement has a concave surface portion at least approximately cylindrical and concentric with said separator roller and defining with a portion of the periphery of said separator roller an at least approximately constant radial clearance.

* * * * *